United States Patent [19]

Saüer et al.

[11] Patent Number: 4,598,642

[45] Date of Patent: Jul. 8, 1986

[54] PLATE CYLINDER FOR INTAGLIO PRINTING PLATES IN A WEB PRINTING MACHINE

[75] Inventors: Hartmut K. Saüer, Himmelstadt; Albrecht J. Germann, Würzburg, both of Fed. Rep. of Germany

[73] Assignee: De La Rue Giori S.A., Switzerland

[21] Appl. No.: 664,486

[22] Filed: Oct. 24, 1984

[30] Foreign Application Priority Data

Nov. 14, 1983 [CH] Switzerland ..... 6111/83

[51] Int. Cl.[4] ..... B41F 27/12

[52] U.S. Cl. ..... 101/415.1

[58] Field of Search ..... 101/415.1, 153, 154, 101/378

[56] References Cited

U.S. PATENT DOCUMENTS

| | | | |
|---|---|---|---|
| 1,643,145 | 9/1927 | Winkler | 101/153 |
| 2,837,025 | 6/1958 | Pechy | 101/415.1 |
| 2,900,904 | 8/1959 | Hantscho | 101/415.1 |
| 2,965,025 | 12/1960 | Mueller | 101/415.1 |
| 3,608,487 | 9/1971 | Luehrs | 101/415.1 |
| 4,292,104 | 9/1981 | Heimbach et al. | 101/153 X |

FOREIGN PATENT DOCUMENTS

| | | | |
|---|---|---|---|
| 1939358 | 6/1970 | Fed. Rep. of Germany | 101/415.1 |
| 1052361 | 12/1966 | United Kingdom | 101/415.1 |

*Primary Examiner*—Charles A. Pearson

*Attorney, Agent, or Firm*—Kane, Dalsimer, Kane, Sullivan and Kurucz

[57] ABSTRACT

The plate cylinder is provided with at least one groove opening out at the cylinder periphery, and disposed therein a fastening device for the two plate ends extending into the groove. This fastening device consists of a tightening bar which can be tilted about an axis parallel to the cylinder axis by means of hydraulically actuatable pistons provided in one groove boundary wall, a clamping piece, and a tightening support. The two plate ends are introduced on both sides of the clamping piece and, when the tightening bar is tilted by the action of the piston, are wedged tight between tightening bar and clamping piece or clamping piece and groove boundary wall, simultaneously tightening the printing plate. The tightening support can be forced radially outwards for the purpose of wedging the tightening bar in its position tightening the plates. The fastening device requires a groove of only small width which moreover tapers radially outwards, forming only a narrow circumferential gap.

8 Claims, 8 Drawing Figures

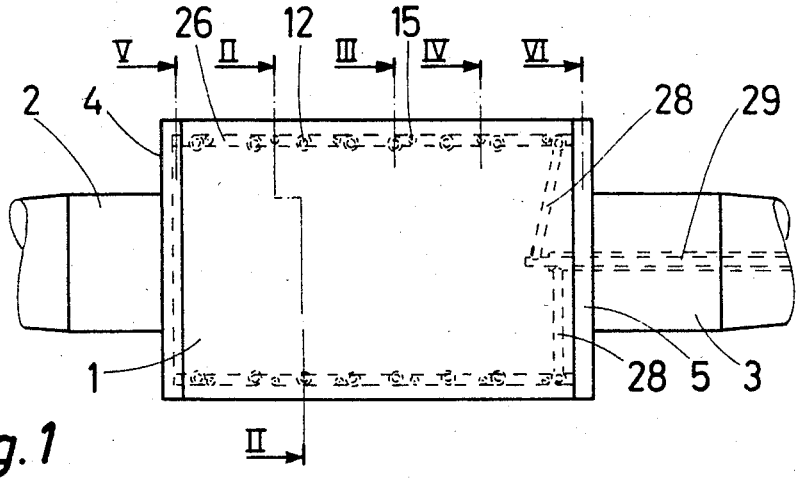
Fig. 1
Fig. 2
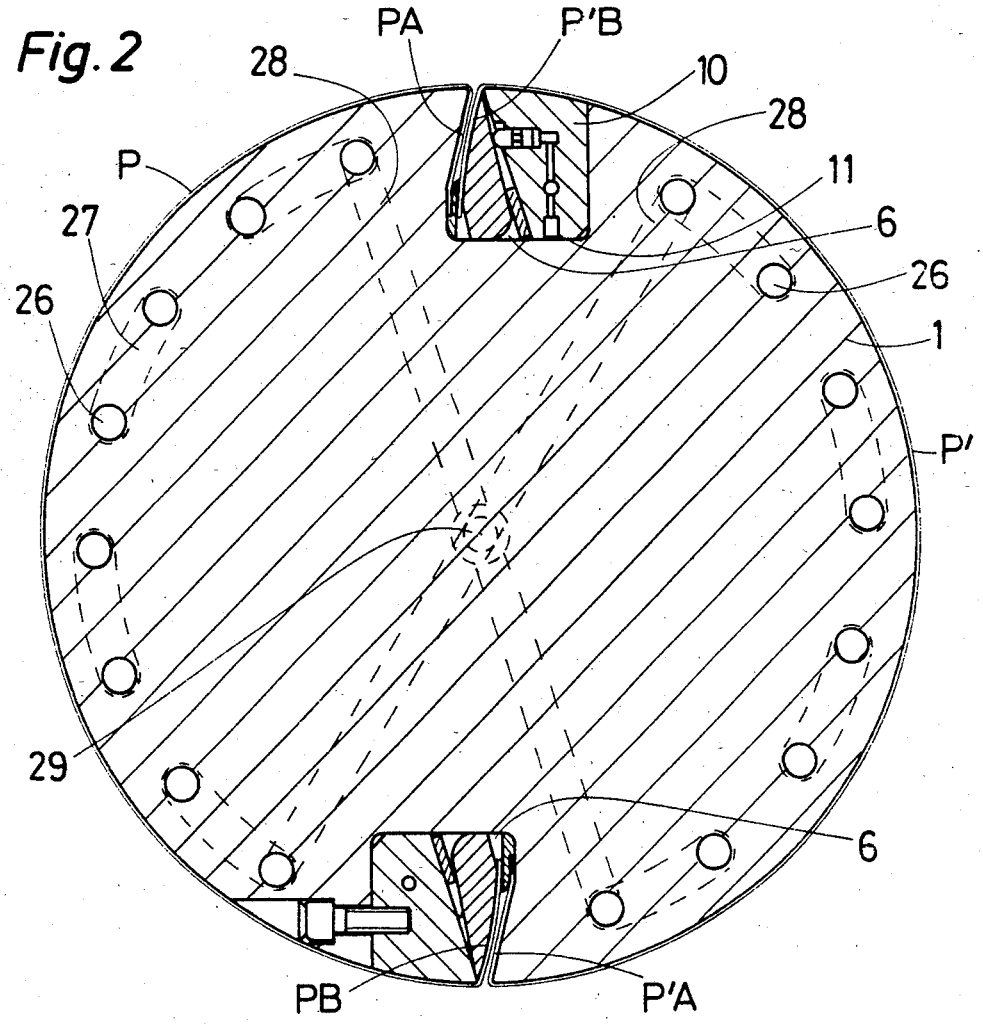

PLATE CYLINDER FOR INTAGLIO PRINTING PLATES IN A WEB PRINTING MACHINE

FIELD OF THE INVENTION

The invention relates to a plate cylinder arranged for mounting intaglio printing plates for web-fed printing machines, with at least one groove opening out at the cylinder periphery, and disposed therein a fastening device for the two plate ends extending into the groove.

PRIOR ART

In one known plate cylinder for intaglio printing machines (German Offenlegungsschrift No. 2 105 633), the fastening device consists of two tightening bars mounted rectilinearly displaceably, on which the two ends of a flexible intaglio printing plate are clamped by means of clamping screws, and tightening screws by which the tightening bars can be displaced for the purpose of tightening the printing plate. This arrangement requires relatively wide grooves in the plate cylinder to accommodate the tightening bars and tightening screws, and is therefore not well suited to web-fed printing machines, in which the openings formed by the grooves in the cylinder surface covered with printing plates should be as small as possible.

Another known fastening device for flexible printing plates (German Auslegeschrift No. 1 939 358) likewise comprises two displaceable tightening bars for clamping the two printing plate ends, while the tightening device consists of pistons which are guided in recesses in the tightening bars and which are supported on a groove boundary wall and hydraulically actuatable. The actuating device for these pistons consists of a hydraulic or pneumatic cylinder which is provided with a control piston and installed at the center of the bottom of the groove between the two tightening bars. This fastening device too requires a very wide groove in the plate cylinder.

The factor common to the above-mentioned known fastening devices is that the devices which clamp the two plate ends and the actual plate tightening device are independent of each other and must be actuated independently of each other when fastening and tightening the printing plates, first by bolting the plate ends tightly on the tightening bars, then by displacing these tightening bars, or at least one of the tightening bars, by means of the tightening device.

An apparatus of a simpler construction for mounting printing plates on a plate cylinder is also already known (U.S. Pat. No. 2,209,127). This apparatus consists simply of a retaining member bolted to the bottom of the groove at the center of the groove, with a radially oriented T-shaped section. The plate ends, which are bent approximately at right angles and extend into the groove, are bent to a V-shape, and to secure them the free arms of the V, which point towards each other, are simply thrust on both sides under the head of the T-shaped section, so that the edges of the plate ends abut against the lower side of this head. In order to force the plate ends into the groove, in each case between the groove boundary wall and the T-shaped section, a special tool is needed with a blade which is inserted in the internal angle of the V-shaped plate ends. This apparatus allows neither wedging of the plate ends, which is essential with intaglio printing plates for reliable mounting of the plates, nor actual tightening of the plates after the edges of the plate ends have engaged beneath the T-shaped section. It is, however, precisely the flexible printing plates which must, to obtain satisfactory print, be clamped on the plate cylinder with relatively high force.

SUMMARY OF THE INVENTION

The invention is based on the object of providing a plate cylinder for web-fed printing with a plate fastening device which has only small space requirements in the circumferential direction of the plate cylinder and therefore requires only a groove of minimum width, so that the cylinder body retains the necessary strength with respect to the high impression forces required in the steel plate engraving process. Moreover, the fastening device should have a simple construction and be designed in such a way that the processes of clamping and tightening the printing plate are considerably facilitated in comparison with hitherto known fastening devices, and, in conjunction with the selected groove geometry, correct clamping of rigid nickel plates such as are preferably used for intaglio printing is rendered possible.

This object is achieved according to the invention by the fact that the fastening device comprises a tightening bar which is common to both plate ends and which has a longer dimension in the radial direction of the plate cylinder than in the circumferential direction and is tiltable about an axis parallel to the cylinder axis, a tightening device disposed in one boundary wall of the groove and acting on one side of the tightening bar, and a clamping piece disposed between the tightening bar and the other boundary wall of the groove, wherein on both sides of this clamping piece are formed approximately radially oriented slots for introducing the two approximately radially folded plate ends which, on actuation of the tightening device by tilting the tightening bar, are clamped simultaneously between the clamping piece and tightening bar on the one hand, and the groove boundary wall adjacent to the clamping piece on the other hand, with simultaneous tightening of the printing plate.

The basic advantages of the invention consist in that both the preferably wedge-shaped tightening bar and the clamping piece can be designed fairly narrow and therefore the groove needs to have only a relatively small width, so that the stability of the plate cylinder body in the region of the groove is impaired only insignificantly, and in that clamping of the two plate ends and tightening of the printing plate are carried out simultaneously in a single process by tilting the tightening bar. Thus the plate cylinder according to the invention fulfils optimally the requirement of importance in web-fed printing, whereby the circumferential gaps should be as narrow as possible, and permits mounting of intaglio printing plates, in particular the very rigid nickel plates, with the application of considerable tightening forces.

Preferably, the arrangement is such that the wedge-shaped tightening bar extends at its tapered end almost to the periphery of the plate cylinder, while the clamping piece is shorter and extends in the radial direction only as far as a fraction of the height of the groove boundary wall, and the groove tapers radially outwards, forming at the cylinder periphery a narrow gap the width of which is only large enough to provide room for the tapered end of the tightening bar and the two plate ends extending into this gap, with sufficient play to tighten the plate. Advantageously, the tightening bar and clamping piece are components loosely inserted in the groove and supported on the bottom of the groove, whereby any fastening means for these components are dispensed with.

In a preferred embodiment, the tightening device consists of several hydraulically activated pistons, the cylinder openings of which are one of the groove boundary walls. In addition, advantageously the cylinder openings with the pistons and all hydraulic supply pipes are accommodated in an insert which is mounted in a mating recess in the plate cylinder, the recess including the groove, and has a peripheral surface which exactly complements the peripheral surface of the plate cylinder. In order to maintain the printing plate in the tightened state even after switching off the hydraulic pressure, advantageously there is provided, between the tightening bar and the groove boundary wall which comprises the pistons, a tightening support which, after tightening and clamping the printing plate, can be forced radially outwards by means of screws accessible at the end faces of the plate cylinder, wedging the tightening bar.

Other appropriate developments of the plate cylinder according to the invention appear from the subsidiary patent claims.

The invention is explained in more detail with the aid of the drawings by a practical example.

BRIEF DESCRIPTION OF THE DRAWINGS

FIG. 1 shows a side view of a plate cylinder according to the invention,

FIG. 2 shows a section along line II—II as in FIG. 1,

DESCRIPTION OF THE PREFERRED EMBODIMENTS

Figure 5:
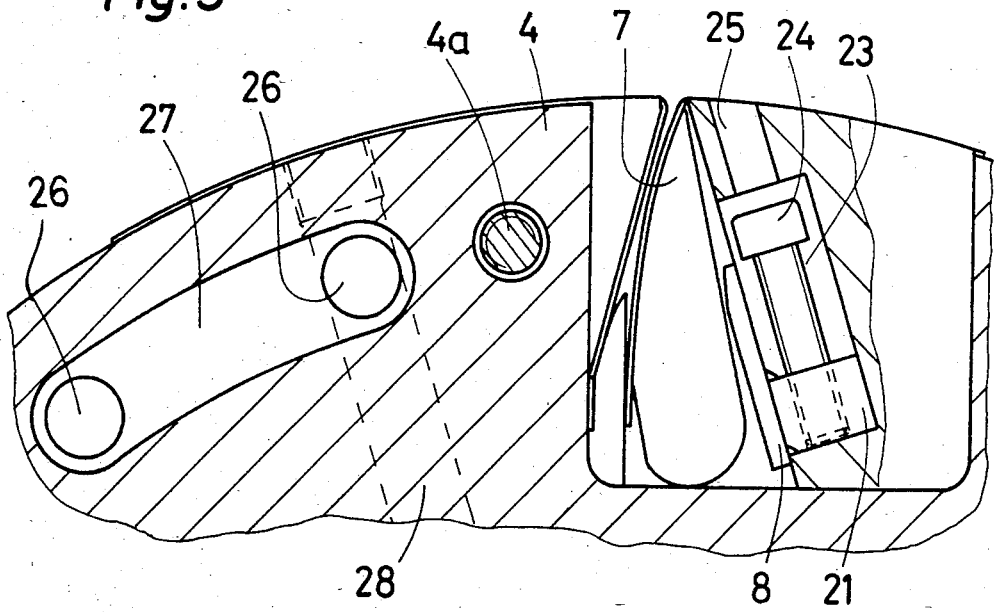
FIG. 5 shows a partial section along line V—V as in FIG. 1 on an enlarged scale.
Figure 6:
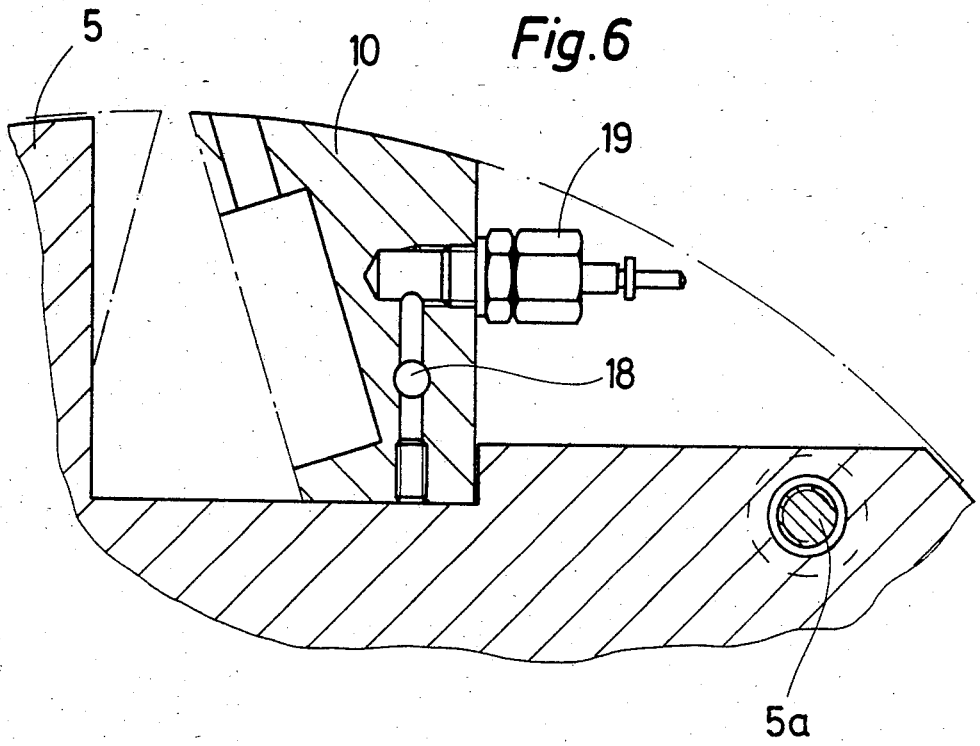
FIG. 6 shows a partial section along line VI—VI as in FIG. 1 on an enlarged scale.

FIG. 1 shows a plate cylinder 1 with its two journals 2 and 3 shown only partially, and two flanges 4 and 5 which are attached to the two end faces by means of bolts 4*a* and 5*a* (FIGS. 5 and 6). In the interior of the plate cylinder 1 is installed a heating and cooling system 26 to 29 which is shown in broken lines and described further below. According to FIG. 2, the plate cylinder 1 is equipped to carry two flexible printing plates P and P′, and for this purpose comprises two diametrically opposed grooves 6 which open out at the cylinder periphery and in which engage the radially inwardly folded plate ends PA and P′B and P′A and PB of the two printing plates P and P′ respectively. Intaglio printing plates are involved here, and the plate cylinder 1 is intended for a web-fed printing machine, that is, for printing paper webs in an intaglio printing process.

Figure 3:
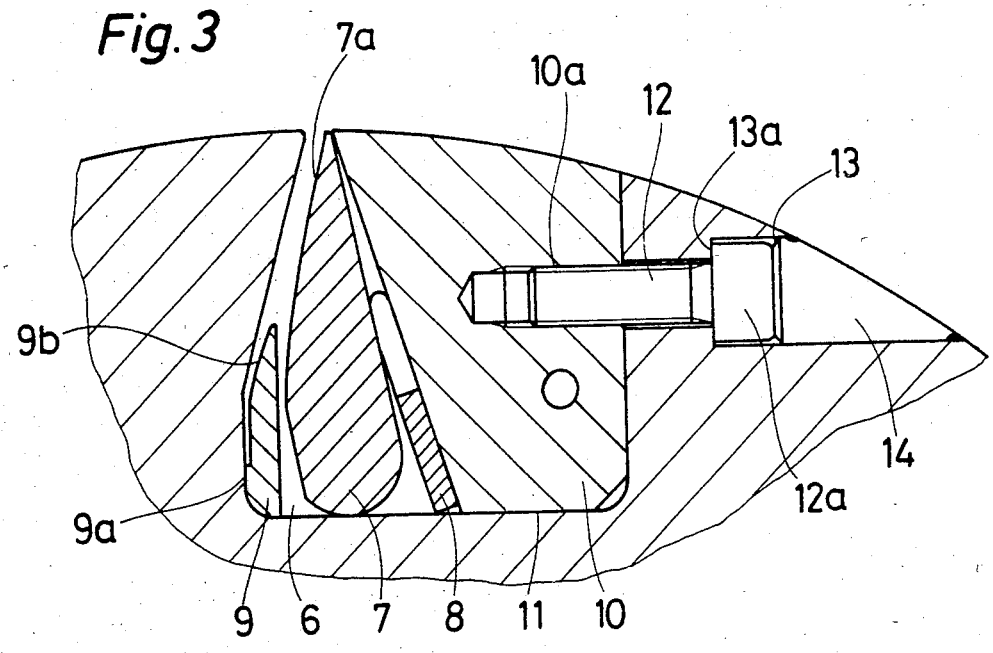
FIG. 3 shows an enlarged partial section extending along line III—III as in FIG. 1, which shows the same components as the lower region of FIG. 2, the printing plates having been omitted.
Figure 4:
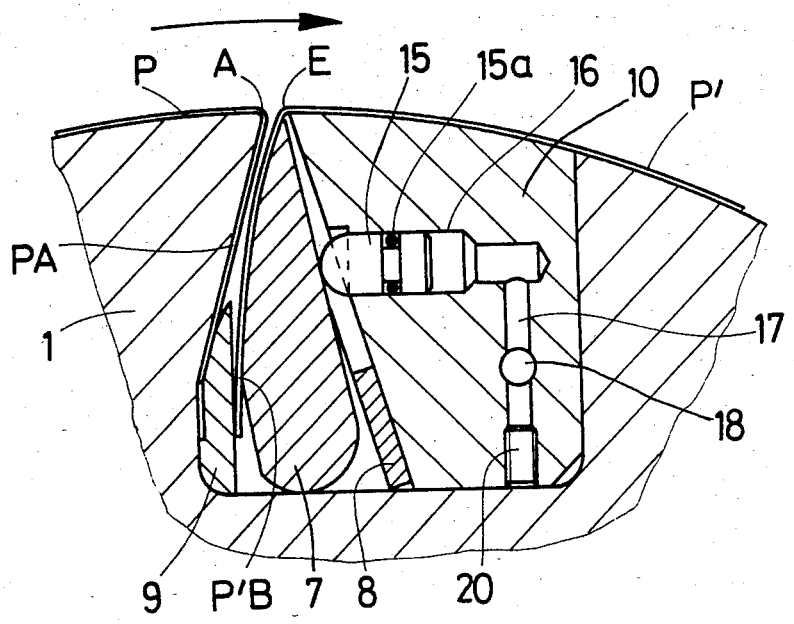
FIG. 4 shows an enlarged partial section extending along line IV—IV as in FIG. 1, which shows the same components as the upper region of FIG. 2.

In each of the grooves 6, the cross-section of which tapers radially outwards, are located the components belonging to the plate fastening device, namely a tightening bar 7, a tightening or blocking support 8 and a clamping piece 9 (FIG. 4). All these components extend over the full axial length of the groove 6, and their ends are accessible for assembly purposes in recesses in the flanges 4 and 5 of the plate cylinder 1, said recesses corresponding to the grooves 6. The tightening bar 7 is a narrow component of wedge-shaped cross-section, the length of which approximately corresponds to the depth of the groove 6 and which is loosely inserted in the groove 6, without any fastening means. The thick rounded end of the tightening bar 7 abuts against the bottom of the groove, and its tapered end extends almost to the envelope of the generated surface of the plate cylinder 1 and therefore lies in the narrow circumferential gap formed by the outwardly tapering groove 6 where it opens out at the cylinder periphery (FIGS. 3 and 4). As long as the printing plates are not attached and tightened, the tightening bar 7 can be tilted a little with slight play determined by the width dimension of the groove 6, about an axis parallel to the cylinder axis, with its rounded end rolling over the bottom of the groove and its outer tapered end moving within the small circumferential gap in the circumferential direction of the plate cylinder 1.

Figure 8:
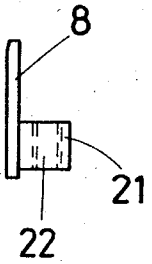
FIG. 8 shows an end view of the tightening support.
Figure 7:
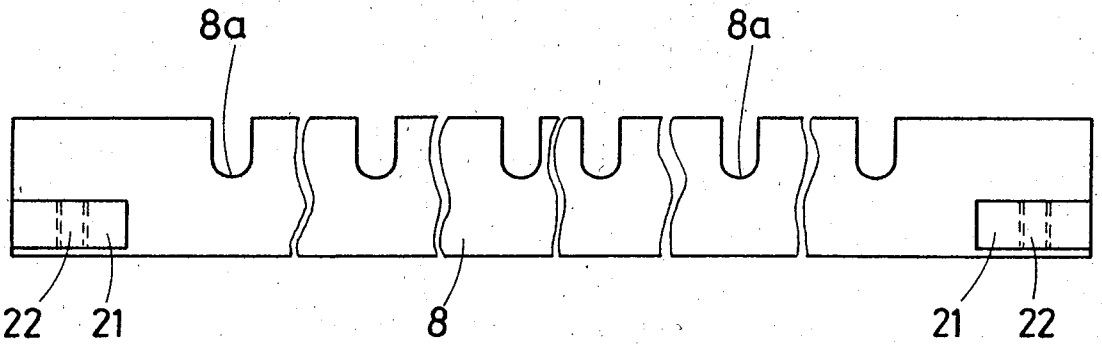
FIG. 7 shows a side view of the tightening support.

The clamping piece 9 is located between the left-hand side of the tightening bar 7, as seen in the view in FIGS. 3 and 4, and the opposite groove boundary wall, and is a narrow component which also abuts loosely against the bottom of the groove and which is only about half as wide as the tightening bar 7 and therefore extends only approximately half-way up the groove boundary wall. On the side of the tightening bar 7 remote from the clamping piece 9 is disposed the tightening support 8, the design of which is shown in FIGS. 7 and 8 and which, as will be described further below, after tightening of the mounted printing plates, can be forced radially outwards, lifting off the bottom of the groove, for the purpose of mechanically wedging the tightening bar 7.

Whereas the boundary wall of the groove 6 on the side of the clamping piece 9 is formed by the body of the plate cylinder 1 itself, the other groove boundary wall is formed by an insert 10 which is mounted in a correspondingly mating recess 11 in the plate cylinder 1, the recess 11 including the groove 6. In this insert is accommodated a tightening device for the tightening bar 7, so that the latter can be tilted appropriately for the purpose of tightening the printing plate P′ retained by it, namely anti-clockwise in the view in FIG. 4. The appropriately machined peripheral surface of the insert 10 exactly complements the peripheral surface of the plate cylinder 1. Bolts 12 are used to secure the insert 10 (FIG. 3), which bolts pass through a stepped opening 13 extending along a secant of the cylinder body and are screwed into a corresponding threaded opening 10*a* in the insert 10, the bolt head 12*a* being fully countersunk and resting on the inner annular edge 13*a* of the stepped opening 13. After tightening the bolt 12, the outer region of the opening 13 beyond the bolt head 12*a* is closed tightly with a stopper 14, the appropriately machined outer surface of which is adapted precisely to the generated surface of the plate cylinder 1. In the example under consideration, as in FIG. 1, eight bolts 12 are provided for securing each insert 10.

In the example under consideration as in FIG. 1, within each insert 10 are mounted six hydraulically actuatable pistons 15 which are displaceable in corresponding cylinder openings 16 which are distributed evenly over the axial length of the plate cylinder 1. The pistons 15, which are provided with O-rings 15*a*, emerge from the groove boundary wall of the insert 10 when pressure is applied to them, and strike the tightening bar 7 which is thus thrust with great force to the left in the view in FIG. 4, so that it is pivoted accordingly. In order not to obstruct piston movements, the tightening support 8 is provided in the region of the pistons with recesses 8*a* (FIG. 7) through which the pistons pass freely. All the cylinder openings 16 in each insert 10 are connected by individual supply pipes 17 to a common supply pipe 18 which extends in the axial direction of the plate cylinder 1 and which leads to a closable inlet 19 which is located at one end face of the plate cylinder 1 (FIG. 6) and which can be connected to an external hydraulic pressure source. The supply pipes 17 and 18 and the inlet 19 are all accommodated in or on the insert 10 whose ends protrude at the end faces of the plate cylinder 1 and are accessible at the flanges 4 and 5. The inner ends of the individual supply pipes 17 on the side of the common pipe 18 remote from the cylinder openings 16 are closed by threaded pins 20. The whole hydraulic system forming the tightening device together with its supply pipes is thus accommodated in the insert 10 and is therefore easy to manufacture and assemble.

The above-described fastening device of the plate cylinder 1 prepared for the assembly of printing plates adopts, before the printing plates are placed on the cylinder, the position shown in FIG. 3, in which the pistons 15 (FIG. 4) are withdrawn into the interior of the groove boundary wall, the tightening support 8 rests on the bottom of the groove, and the tightening bar 7 abuts by its tapered end against the outer end of the groove boundary wall of the insert 10. To assemble the printing plates, when the printing plates are placed on the periphery of the plate cylinder 1 the correspondingly folded plate ends are introduced into the groove 6 in such a way that plate end PA of printing plate P passes into the slot between the clamping piece 9 and the adjacent groove boundary wall, and end P'B of printing plate P' passes between the clamping piece 9 and the tightening bar 7 (FIG. 4).

In order to ensure satisfactory close-fitting abutment of the plate end P'B of the plate P', which is to be tightened subsequently, against the tightening bar 7, the surface thereof on the side of the clamping piece 9, which acts as a contact surface 7*a*, is adapted to the curvature of the printing plate with the exception of a radially inner section. At the inner end of the curved section, the surface is slightly angled to form an edge, in order to increase the clamping effect on the plate end extending over this edge. To insert the other plate end PA, the side of the clamping piece 9 facing towards the adjacent groove boundary wall is stepped in such a way that the radially outer section extending over most of the length of this clamping piece 9 is reduced by about the thickness of the printing plate, forming a wedging surface 9*b*, while the inner section 9*a* abuts against the groove boundary wall. The wedging surface 9*b* is slightly angled about half-way up to form an edge. The groove boundary wall opposite the wedging surface 9*b* has a correspondingly angled shape, so that between wedging surface 9*b* and groove boundary wall is formed an essentially parallel slot in which the plate end PA is inserted as far as the above-mentioned edge, that is, by the depth of the outer non-angled wedging surface section.

During operation of the web-fed printing machine, the plate cylinder 1 rolls in the direction of the arrow in FIG. 4 over the impression cylinder, not shown, under high contact pressure. Each time that the groove 6 or its circumferential gap has passed the impression cylinder, the boundary edge A of the plate cylinder 1 at the trailing boundary of the circumferential gap, as seen in the direction of rotation, represents the starting point of printing, while after one turn of the cylinder the other boundary edge E of the insert 10 represents the respective finishing point of printing. The two boundary edges A and E are very slightly rounded, preferably with a small radius between 1.4 and 1.8 mm, in particular 1.5 mm, the curvature of the leading boundary edge E being complemented by the correspondingly rounded tapered end of the tightening bar 7 which has been machined together with this boundary edge while abutting against it. The angle at boundary edge A, that is, between the groove boundary wall on the side of the clamping piece and the adjoining peripheral section of the plate cylinder 1, is slightly less than 90°, preferably about 75°. The angle at the other boundary edge E between the contact surface of the tightening bar 7 and the adjoining peripheral section of the plate cylinder 1 is greater than 90°, preferably about 105°. The above-described configuration is particularly advantageous, on the one hand for tightening the printing plates, and on the other hand for maintaining a stable position of the printing plates during operation of the web-fed printing machine, in particular under the effect of the strong contact pressure forces of the impression cylinder.

After the folded plate ends, as described, have been inserted in the groove 6, tightening of the printing plates is carried out by connecting the hydraulic system in each of the inserts 10 to an external pressure source and hence applying a presettable force to all the pistons 15. In the process, the tightening bar 7 is accordingly pivoted by the pistons 15 anti-clockwise as in FIG. 4, the tapered end of the tightening bar 7 being lifted a short distance off the groove boundary wall of the insert 10, as illustrated in FIG. 4.

This process of course takes place simultaneously at all mounting and clamping points if, as in the example under consideration, the plate cylinder is arranged to receive several printing plates. In the process, due to the movement of the tightening bar 7 the printing plates are clamped fast in the circumferential direction, and at the same time the two plate ends which engage in each of the grooves 6 are wedged together simultaneously between tightening bar 7 and clamping piece 9 or between clamping piece 9 and adjacent groove boundary wall. Tightening as well as fastening of the two plate ends in each groove therefore takes place simultaneously in a single procedure, namely actuation of the pistons 15 and, caused by the latter, pivoting of the tightening bars 7. As the tapered end of the latter extends practically to the height of the cylinder surface and moves along the envelope of this surface during pivoting, the printing plate concerned is pulled during tightening, without being deformed, only in the circumferential direction, but without deformation over an edge or rounded substrate. Since moreover the hydraulically operating tightening device ensures that force is applied uniformly to the printing plate, the device allows satisfactory and rigid tightening, so that above all rigid nickel plates can be mounted satisfactorily.

In order to maintain the final position of the tightening bar 7 after tightening and hence the tightened state of the printing plate, mechanical fixing of the tightening bar 7 by means of the already mentioned tightening support 8 is provided. This tightening support 8, which is shown in detail in FIGS. 7 and 8 and which comprises, for free movement of the pistons 15, the already mentioned recesses 8*a*, has at its ends protruding at the end faces of the plate cylinder 1 perpendicularly projecting lugs 21 which are provided with a threaded bore 22 and are accessible in corresponding recesses in the flanges 4 and 5, as is shown in FIG. 5 for flange 4. As in FIG. 5, the lug 21 concerned extends into a mating recess 23 in the side wall of the insert 10, the ends of which likewise protrude at the end faces of the plate cylinder 1. Into each of the two threaded bores 22 is screwed a screw 24, which as in FIG. 5 is accommodated with the lug 21 in the above-mentioned recess 23 in the insert 10 and whose head is accessible for the purpose of screwing through a bore 25 which is arranged in extension of the screw 24 and which opens out at the outer periphery of the insert 10. In order to force the tightening support 8 radially outwards for the purpose of wedging the tightening bar 7 after tightening the printing plates, the screws 24 which are supported on the bottom of the recesses 23 need only to be tightened to a sufficient degree. To obtain a wedge effect, the radially outer edge of the tightening support 8 is rounded on the side facing towards the tightening bar 7. In the view in FIG. 5, the tightening support 8 is located in its raised clamping position. Subsequently, the pressure which acts on the pistons 15 can be switched off, and the hydraulic system cut off from the external pressure source.

The above-described mounting and tightening device requires a groove 6 of only small width and in particular at the groove opening only a narrow circumferential gap, the width of which is only large enough for the tapered end of the tightening bar 7 and the two plate ends extending into this circumferential gap to have sufficient play for tightening the plates; as illustrated in particular by FIG. 4, the width of the circumferential gap need be only about four to five times the thickness of the printing plate. Hence the circumference of the plate cylinder can be utilised optimally for the printing plates, and the plate mounting gap which is undesirable in web-fed printing machines is reduced to a minimum. Moreover, by this means the mechanical strength of the plate cylinder to resist deflection and pressure even in the region of the two plate ends is fully retained, even under the very high pressures required in the intaglio printing process, which are typically 5000–6000N per cm line load.

The plate cylinder according to the invention may of course also be arranged to receive more than two printing plates and provided with a corresponding number of grooves and fastening devices; but it may also bear only one printing plate, in which case only one groove is provided for the two plate ends.

In the example under consideration, the plate cylinder is further provided with an internal heating and cooling system which allows heating and/or cooling with a circulating heating or cooling medium even during mounting of the printing plates. For this purpose, in the cylinder body in the vicinity of the cylinder surface are provided paraxial pipes 26 (FIGS. 1, 2 and 5) which are evenly distributed over the circumferential region. In the flanges 4 and 5, respectively adjacent pipes 26 are interconnected in pairs by connecting channels 27 extending parallel to the circumference (FIGS. 2 and 5), in such a way that the pipes 26 in each half of the cylinder delimited by the two grooves 6 form a continuous heating and cooling coil. The beginning and end of each heating and cooling coil are connected by radial pipes 28 (FIGS. 1, 2 and 5) to a coaxial pipe 29 (FIGS. 1 and 2) which extends through the journal 3 and which contains the heating or cooling medium feed pipe, for example in the inner channel, and the return pipe, for example in the radially outer channel.

The plate cylinder described in particularly suited to coact with an impression cylinder which is described in the earlier U.S. copending patent application Ser. No. 568,364, filed 1/05/84 by the same assignee and which bears a rubber blanket mounted in a groove of only very small width.

What is claimed is:

1. A plate cylinder for mounting intaglio printing plates with radially folded plate ends in web-fed printing machines comprising:

a body with a body axis and a cylindrical surface formed with at least one groove defined by a first boundary wall, a bottom, and a second boundary wall and opening towards said surface;

fastening means provided for said plate ends and comprising:

a tightening bar having a wedge-shape with a major dimension oriented radially, and a rounded inner end contacting said groove bottom, said rounded inner end forming a rocking surface so that said tightening bar is tiltably supported in said groove, said tightening bar being loosely disposed within said groove;

a tightening device disposed in said first boundary wall and consisting of a plurality of hydraulic pistons positioned axially along the first boundary wall arranged to selectively tilt the tightening bar away from said first boundary wall when pressurized for tensioning a plate;

a rigid clamping piece disposed between said tightening bar and said second boundary wall, said clamping piece being formed with two generally radial side walls and extending along said secondary boundary wall, said clamping piece having a radial dimension which is less than the radial dimension of said second boundary wall, a slot for engaging one of said plate ends being located adjacent each of said radial side walls; and a blocking support disposed between said first boundary wall and said tightening bar for maintaining said tightening bar away from said first boundary wall after said hydraulic pistons are depressurized;

said tightening bar and said clamping piece cooperating to clamp simultaneously the plate ends and to tension the plate as said tightening bar is tilted by said tightening device.

2. Plate cylinder according to claim 1, wherein the tightening bar has a tapered end opposite said inner end and extending approximately to an envelope defining the cylindrical surface and said groove is tapering radially outwards, forming at the cylinder periphery a narrow circumferential gap whose width is only large enough to accommodate the tapered end of the tightening bar and the two plate ends extending into this circumferential gap, with sufficient play to tighten the plate.

3. Plate cylinder according to claim 2, wherein the tightening bar has a side surface facing said clamping piece for engaging one of said plate ends said one plate end having a curvature, and said side surface having a radial section which matches said curvature; said side surface forming with the adjoining peripheral section of the plate cylinder the leading boundary edge of the circumferential gap as seen in the direction of rotation of the plate cylinder during operation of the printing machine, said side surface and its adjoining peripheral section of the plate cylinder defining a first angle which is greater than 90°, while the second boundary wall forms with the adjoining peripheral section of the plate cylinder the trailing boundary edge of the circumferential gap, said second boundary wall and its adjoining peripheral section of the plate cylinder defining a second angle which is less than 90°, said boundary edges being rounded with a radius in the range of 1.4 to 1.8 mm, and said tapered end of said tightening bar being machined together with the leading boundary edge.

4. The plate cylinder of claim 3 wherein said first angle is about 105° and said second angle is about 75°.

5. The plate cylinder of claim 1 wherein one of said plate ends is clamped between said tightening bar and said clamping piece and the other of said plate ends is clamped between said clamping piece and said second boundary wall, said clamping piece being loosely disposed within said groove.

6. Plate cylinder according to claim 5, wherein the radial side wall of the clamping piece facing towards the second boundary wall is stepped and has an inner section abutting the second boundary wall and an outer section which is reduced by about the thickness of the printing plate to form a clamping surface, and wherein in the assembled state of the printing plate, the second plate end extends into the slot between clamping surface and second boundary wall, by a length which is less than the depth of the slot.

7. The plate cylinder of claim 1 wherein said blocking support has two axial ends with lugs and said plate cylinder is further provided with radial screws arranged to threadably engage said lugs for moving said blocking support radially inward and outward, said blocking support being arranged to wedge said tightening bar when moved outwardly.

8. The plate cylinder of claim 1 further comprising:

a recess circumferentially adjacent to said groove;

an insert mounted within said recess, said insert having cylinder holes for housing said pistons, pipes for providing working fluid to said cylinder holes, said insert being defined by said first boundary wall, and an outer wall, said outer wall being continuous with the cylindrical surface of the plate cylinder; mounting bolts for mounting said insert to said plate cylinder; and stoppers for covering said bolts, said stoppers having an outer surface matching the cylindrical surface.

* * * * *

UNITED STATES PATENT AND TRADEMARK OFFICE

CERTIFICATE OF CORRECTION

PATENT NO. : 4,598,642

DATED : July 8, 1986

INVENTOR(S) : Hartmut K. Sauer and Albrecht J. Germann

It is certified that error appears in the above-identified patent and that said Letters Patent are hereby corrected as shown below:

Column 3, line 8, after "are" insert

--provided in--.

Signed and Sealed this

Twenty-fifth Day of November, 1986

*Attest:*

DONALD J. QUIGG

*Attesting Officer* *Commissioner of Patents and Trademarks*